US006612770B2

(12) United States Patent
Aoyama

(10) Patent No.: US 6,612,770 B2
(45) Date of Patent: Sep. 2, 2003

(54) BRUSH HEAD OF TOOTHBRUSH

(76) Inventor: Yoshihiro Aoyama, 1-3-8, Hiroo, Shibuya-ku, Tokyo (JP)

( * ) Notice: Subject to any disclaimer, the term of this patent is extended or adjusted under 35 U.S.C. 154(b) by 113 days.

(21) Appl. No.: 09/793,984

(22) Filed: Feb. 28, 2001

(65) Prior Publication Data

US 2002/0015612 A1 Feb. 7, 2002

(30) Foreign Application Priority Data

Jul. 28, 2000 (JP) ..... 2000-229674

(51) Int. Cl.[7] ..... A46B 11/04
(52) U.S. Cl. ..... 401/286; 401/268; 15/172
(58) Field of Search ..... 401/268, 286; 15/167.1, 172, 201

(56) References Cited

U.S. PATENT DOCUMENTS 2,438,268 A * 3/1948 Bressler ..... 15/167.1
2,676,350 A * 4/1954 Bressler ..... 15/167.1
2,682,703 A * 8/1954 Dellenbach ..... 15/167.1
4,654,922 A * 4/1987 Chen ..... 15/172
5,297,884 A * 3/1994 Cubillas ..... 401/268
5,373,602 A * 12/1994 Bang ..... 15/167.1
5,946,759 A * 9/1999 Cann ..... 15/167.1
5,991,958 A * 11/1999 Hohlbein ..... 15/167.1
6,327,735 B1 * 12/2001 Kramer ..... 15/167.1

* cited by examiner

*Primary Examiner*—Gregory Huson
*Assistant Examiner*—Huyen Le
(74) *Attorney, Agent, or Firm*—Rader, Fishman & Grauer PLLC

(57) ABSTRACT

The toothbrush is designed to be flexibly adjustable depending on the dentition and the like of each user. The brush head 1 of the toothbrush has two or more brush segments 2*a*, 2*b* and 2*c* each having bristle bundles 6 implanted in a brush base 5, which are arranged in the axial direction of the toothbrush; and the brush segments are connected to each other with a resilient resin material, a rubber material, a spring, a rubber ligament, a magnet or other restoring means which permits restorable torsional and bending deformations in all directions with respect to the axis of the toothbrush; the restoring means having at the proximal end a neck 3 for fitting the brush head to the distal end of a handle 4.

19 Claims, 11 Drawing Sheets

BRUSH HEAD OF TOOTHBRUSH

BACKGROUND OF THE INVENTION

The present invention relates to a brush head of a toothbrush having a brush section for brushing teeth, which is attached to the distal end of a gripping handle, particularly to a brush head of a toothbrush which can reduce portions to be left unbrushed even when intricate rows of teeth are brushed with it.

DESCRIPTION OF THE RELATED ART

Toothbrushes each having a gripping handle and a brush head supported at the distal end of the handle are commercially available, and they come in different types in terms of the shape of the handle, the size of the head, the stiffness of bristles implanted in the head, etc. For example, there are those having curved handles, those having small heads and those in which stiffness of bristles to be implanted in the heads are varied depending on the position, so that users can select optimum ones in accordance with use conditions including the mouth size and the like.

However, dentition including occlusion differs greatly from person to person, so that even if one selects an optimum one from the various kinds of toothbrushes as described above, it is sometimes difficult to brush ones teeth sufficiently with it.

More specifically, since the shape of the oral cavity differs from person to person, there is a limit for a single toothbrush to clean ones teeth entirely, and some teeth cannot be brushed sufficiently depending on the positions and portions of them. Thus, one needs some additional brushes including interdental brushes, disadvantageously.

In addition, the toothbrushes of the prior art involve a problem that the brush applies pressure unevenly to the teeth to be unable to achieve efficient brushing. More specifically, in a brush head 101 of a conventional toothbrush, when bristle bundles 102 are applied to the surface of a tooth T, as shown in FIG. 21, there occur a portion T1 to which the bristle bundles 102 are applied strongly and a portion T2 to which the bristle bundles 102 are applied softly. Thus, the portion T2 remains insufficiently brushed to be causative of dental caries.

It is an object of the present invention to provide a brush head of a toothbrush capable of brushing teeth without undergoing influences of conditions including dentition, which differ from person to person.

SUMMARY OF THE INVENTION

In order to solve the problems described above, the brush head according to the present invention was accomplished considering a constitution which enables efficient brushing of teeth by applying necessary pressures to necessary portions of the teeth and no excessive pressure to portions requiring less pressure. The constitution of the brush head of a toothbrush is as given below.

That is, the brush head of a toothbrush has a gripping handle and a brush section for brushing teeth attached to a distal end of the handle; the brush section containing a brush base having bristle bundles implanted therein; wherein the brush section is divided into at least two brush segments that are arranged along an axis of the toothbrush; and the brush segments are connected to each other with a resilient resin material, a rubber material, a spring, a rubber ligament, a magnet or other restoring means which permits restorable torsional and bending deformations in all directions with respect to the toothbrush axis.

The brush head having the above constitution undergoes resilient movement freely to detour obstructive protrusions if present to give a toothbrush which can brush teeth without fail to the depth of every recess.

The brush base can be formed easily as an integral part by using a resilient material which permits restorable torsional and bending deformations in all directions with respect to the toothbrush axis.

The restoring means is provided at each end with a mounting/dismounting mechanism to be removably fixed to the brush base, enabling replacement of the brush if worn out.

The mounting/dismounting mechanism is a threaded portion which is removably screwed into a threaded hole defined in the brush base along the toothbrush axis or is a fitting piece, which is retractably fitted into a bore defined in the brush base in the axial direction of the toothbrush and has a rectangular cross section or other shapes permitting advancing and retracting movements only; and an engaging mechanism is located between the fitting piece and the brush base, the engaging mechanism being a resilient claw which removably engages the fitting piece with the brush base, thus securing replaceability.

The brush head further has a pivot shaft for pivotally supporting the brush segments with respect to the toothbrush axis, and the pivot shaft is attached to the handle, thus securing the action of the brush head to the distal end under two-dimensional deformation.

The brush base has a bristled portion formed separate from a main body of the brush base, and a screw engagement mechanism, a fitting mechanism or a mounting/dismounting mechanism of other constitutions for removably locking the bristled portion against the brush base is interposed between them, thus enabling minimum replacement of parts depending on the degree of wearing or contamination.

The brush head having a passage communicating from the handle to the brush base and opens between the bristle bundles facilitates cleaning of the toothbrush.

A ball joint having a lock nut interposed between the brush section and the handle enables setting of the angle of the brush section depending on the use site.

Various types of handles can selectively be used by interposing a mounting/dismounting mechanism between the brush section and the handle.

Other aspects and advantages of the invention will become apparent from the following description, taken in conjunction with the accompanying drawings illustrated by way of examples the principles of the invention.

BRIEF DESCRIPTION OF THE DRAWINGS

The invention together with the objects and advantages thereof, may best be understood by reference to the following description of the presently preferred embodiments together with the accompanying drawings in which.

DETAILED DESCRIPTION OF THE PREFERRED EMBODIMENTS

Modes for carrying out the present invention will be described below.

A flexible brush head will be described first.

Figure 1:
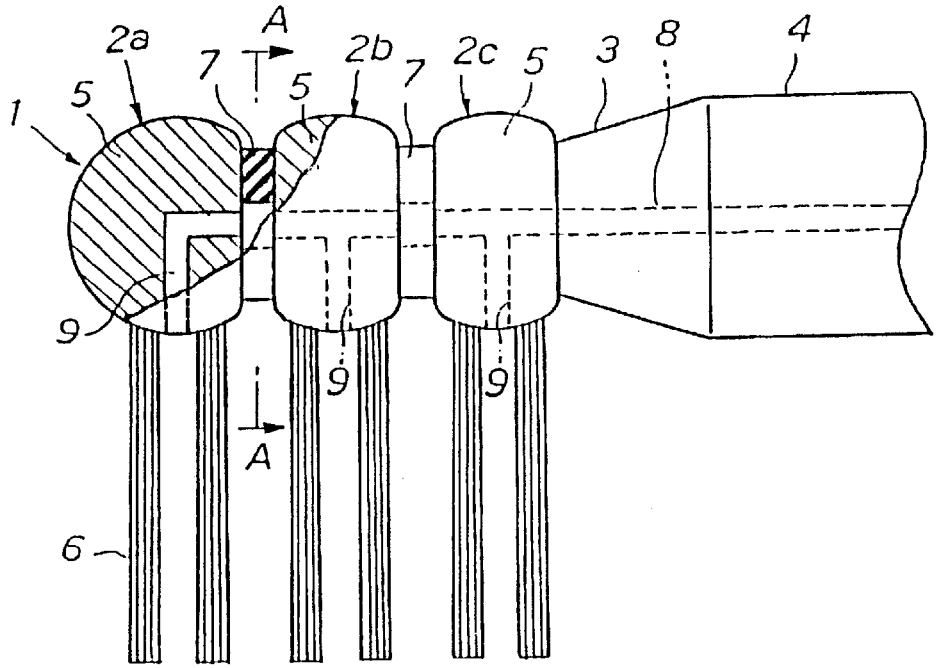
FIG. 1 is a partly sectional side view of a brush head according to the present invention using a resilient resin material.
Figure 2:
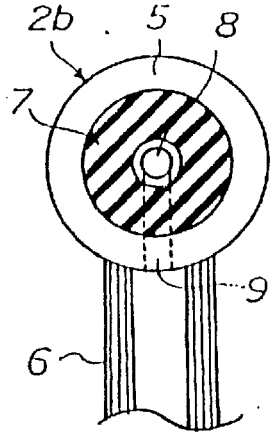
FIG. 2 is a cross-sectional view taken along the line A—A in FIG. 1.

FIG. 1 is a partly sectional side view of the brush head according to the present invention using a resilient resin material; and FIG. 2 is a cross-sectional view taken along the line A—A in FIG. 1.

The brush head 1 is composed essentially of a plurality of brush segments 2*a,* 2*b* and 2*c* and a neck 3. The neck 3 is formed integrally with a gripping handle 4 of a toothbrush at the distal end thereof.

The brush segments 2*a,* 2*b* and 2*c* each have a brush base 5 and bristle bundles 6 implanted therein. The brush segments 2*a,* 2*b* and 2*c* are arranged along the axis of the toothbrush and are connected to one another with restoring means made of an elastic resin material 7 which permits restorable torsional and bending deformation in all directions with respect to the toothbrush axis.

The torsional and bending deformation in all directions with respect to the toothbrush axis referred to here means twisting movements on the axis; back-and-forth, right-and-left and up-and-down movements with respect to the axis and compound movements thereof. While the brush segments are arranged along the axis of the straight toothbrush, the present invention is not to be limited to this arrangement, but the brush segments may be arranged along the axis of a curved toothbrush.

Each brush base 5 has a communicating passage 9 extended from a passage 8 defined along the center of the handle 4 through the neck 3 and the resilient resin piece 7 and opening toward the bristle bundles 6. The outermost brush segment 2*a* has a closed end. The passage 8 is designed to permit passage of a liquid, a gas, a fluid and the like, typically, water, an antiseptic solution, a toothpaste (a tooth powder), a toothbrush cleaner and air for drying the toothbrush.

In the brush head 1 having the above constitution, the brush segments 2*a,* 2*b* and 2*c* can be twisted and bended freely in all directions independently with respect to the axis of the toothbrush within the resilience of the resilient resin material 7. Thus, when the toothbrush having the brush head 1 according to this embodiment is used, a user grips the handle 4 and applies the bristle bundles 6 against the teeth to brush them like one uses a conventional toothbrush. If the bristle bundles 6 are subjected to strong pressures, the brush segments are caused to deform (retract, twist, etc.) freely by the reactive forces from the tooth surfaces, respectively. When the brush segments are brought to positions where they are subjected to low pressures, the segments resiliently return by themselves to their original positions, independently. As a result, the ends of bristles can be applied all over the tooth surfaces, so that the teeth can be cleaned evenly and that injury of the teeth by the brush can be avoided.

As described above, when tooth rows having great irregularity are to be brushed, the brush segments freely undergo resilient motions independently in accordance with tooth conditions including dentition which vary among individuals, even if there are obstructive protrusions. Thus, the brush segments undergo resilient deformation including retraction and twisting so as to avoid such obstacles, so that the ends of the bristles can be automatically oriented to be brought into contact with the tooth surfaces evenly, enabling brushing of the teeth in every hole and corner without failure.

Meanwhile, if water, air or the like is supplied through the passage 8 penetrating the handle 4 along its center, leavings present around the roots of the bristle bundles 6 can be flushed away or blown off, facilitating cleaning of the toothbrush.

While the brush segments 2*a,* 2*b,* and 2*c* and the restoring means are formed as separate bodies in this embodiment, they may be formed integrally using the same material. Further, a rubber material, springs, rubber ligaments, magnets, etc. can be used as the restoring means, as well as, the resilient resin material.

Figure 3:
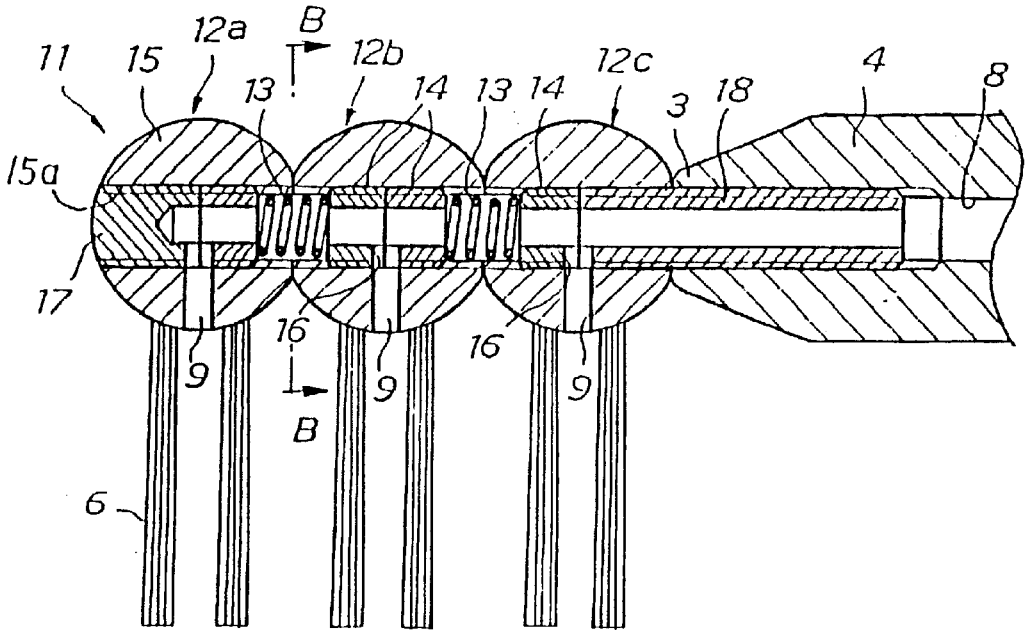
FIG. 3 is a vertical cross-sectional view of an adjustable brush head according to the present invention, which uses springs.
Figure 4:
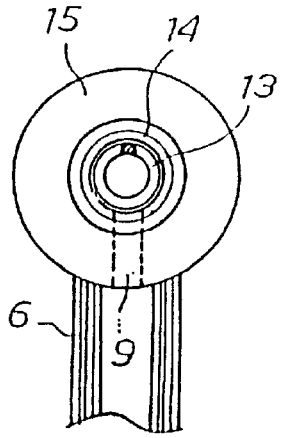
FIG. 4 is a cross-sectional view taken along the line B—B in FIG. 3.

FIG. 3 is a vertical cross-sectional view of a flexible brush head according to the present invention, which uses springs;

and FIG. 4 is a cross-sectional view taken along the line B—B in FIG. 3. In the following description, the same and like elements as in the foregoing embodiment are affixed with the same reference numbers respectively, and detailed description of them will be omitted.

The brush head 11 is of a constitution in which a plurality of brush segments 12*a,* 12*b* and 12*c* are connected to one another with springs 13 as the restoring means, respectively. Each spring 13 has at each end a ring-shaped threaded piece 14 which constitutes a mounting/dismounting mechanism to be screwed into threaded holes 15*a* defined through the brush segments 12*a,* 12*b* and 12*c* in the axial direction of the toothbrush and connects adjacent brush bases 15 to each other.

Each brush base 15 has a communicating passage 9, and a notch 16 is formed in the threaded piece 14 at a portion opposing the communicating passage 9. A cap 17 is screwed into the outermost brush base 15, while a pipe 18 is screwed to the neck 3 formed integrally with the handle 4, so as to fix the threaded pieces 14 and to be removable from the handle 4.

In the brush head 11 having the above constitution, the springs 13 permit twisting and bending of the head 11 in all directions with respect to the toothbrush axis, the brush head 11 can move freely in the same manner as describe above. Further, if the bristle bundles 6 are worn out, the brush segments 12*a,* 12*b* and 12*c* can be replaced by unscrewing the threaded pieces 14.

Figure 5:
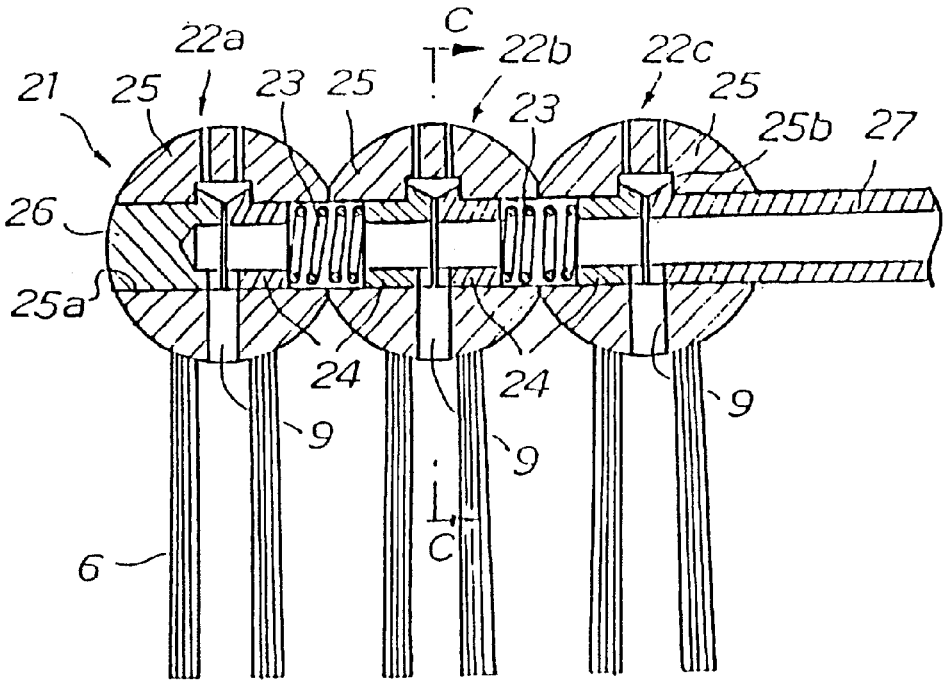
FIG. 5 is a vertical cross-sectional view of an adjustable brush head according to another embodiment of the present invention, which uses springs.
Figure 6:
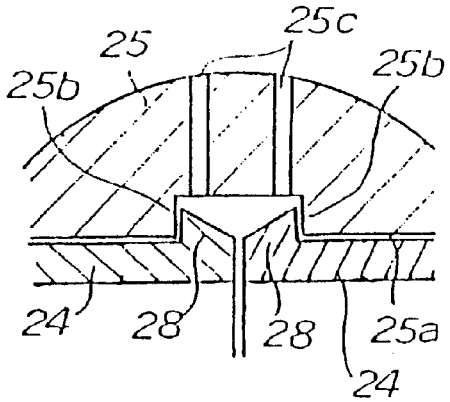
FIG. 6 is an enlarged view of a substantial part of FIG. 5.
Figure 7:
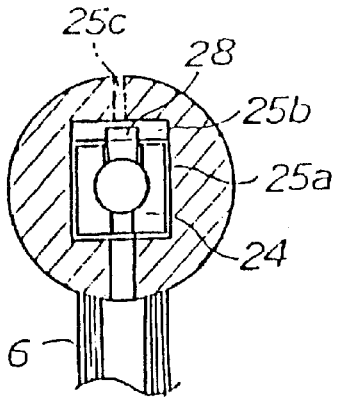
FIG. 7 is a cross-sectional view taken along the line C—C in FIG. 5.

FIG. 5 is a vertical cross-sectional view of an adjustable brush head according to another embodiment of the present invention, which uses springs; FIG. 6 is an enlarged view of a substantial part of FIG. 5; and FIG. 7 is a cross-sectional view taken along the line C—C in FIG. 5.

The brush head 21 is of the same constitution as described above and has a plurality of brush segments 22*a,* 22*b* and 22*c* connected to one another by springs 23. Each spring 23 has at each end a fitting piece 24 which constitutes a mounting/dismounting mechanism to be retractably fitted into a fitting hole 25*a* having a rectangular cross-section or the like permitting only advancing and retracting motions of each brush base 25. A cap 26 is screwed into the fitting hole 25*a* of the outermost brush base 25, while a square pipe 27 is fitted into the neck 3 formed integrally with the handle 4.

The fitting pieces 24, the cap 26 and the square pipe 27 each have a resilient claw 28 which is engaged with a step 25*b* formed in the fitting hole 25*a* of each brush base 25. Disengaging holes 25*c* are defined in the brush bases 25 to oppose the steps 25 respectively.

The fitting pieces 24 and the like are locked by inserting them to the fitting holes 25*a* and engaging the resilient claws 28 with the steps 25*b* respectively. The resilient claws 28 can be disengaged from the steps 25*b* by pushing the former with a narrow stick through the disengaging holes 25*c,* respectively.

Next, an oscillatable brush head according to the present invention will be described.

Figure 8:
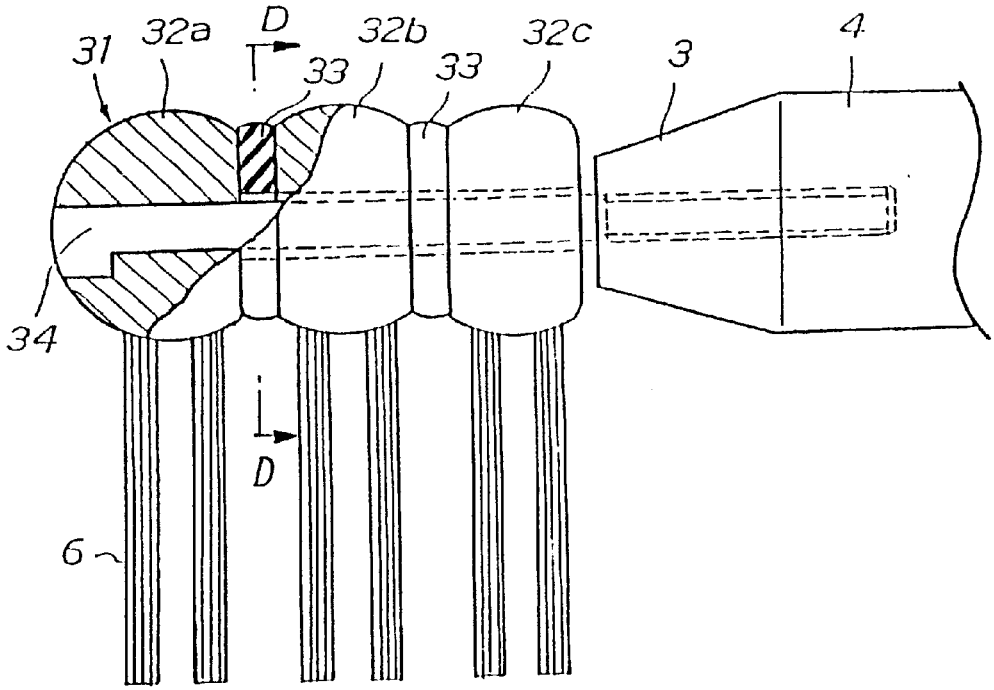
FIG. 8 is a partly sectional side view of an oscillatable brush head according to the present invention.
Figure 9:
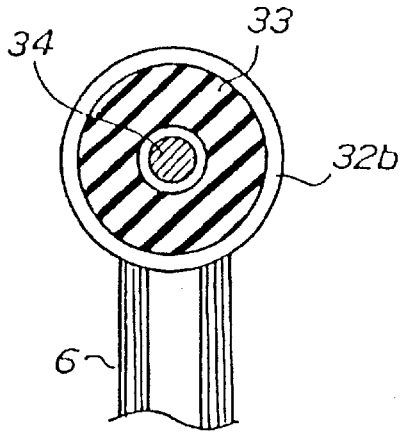
FIG. 9 is a cross-sectional view taken along the line D—D in FIG. 8.

FIG. 8 is a partly sectional side view of the oscillatable brush head according to the present invention; and FIG. 9 is a cross-sectional view taken along the line D—D in FIG. 8.

The brush head 31 is of a constitution in which a plurality of brush segments 32*a,* 32*b* and 32*c* are connected to one another with rubbery restoring means 33. A center shaft 34 is fixed to the outermost brush segment 32, while the other brush segments 32*b* and 32*c* are fitted onto this shaft 34 to be supported thereby rotatably, and the resulting shaft 34 is screwed into the neck 3.

The brush head 31 of this embodiment is used in the same manner as in the first embodiment. If bristle bundles 6 of the brush segments 32*b* and 32*c* are subjected to strong pressures, the brush segments 32*b* and 32C are turned by the reactive forces from the tooth surfaces respectively to twist on the center shaft 33 the restoring means 33 such as of a rubber material. When the brush segments are brought to positions where they are subjected to low pressures, these segments resiliently return by themselves to their original positions, respectively.

Thus, in the brush head 31 having the constitution as described above, the intermediate brush segments 32*b* and 32*c* can be oscillated on the center shaft 34, the brush head 31 can brush teeth by its oscillating motions, while avoiding obstacles.

While the center shaft 34 can be prepared using a rigid material, it may be prepared using a flexible material such as a wire. In this case, the brush head can undergo not only the oscillating motion but also the free motions as described above depending on the force applied to it. The same shall apply to center shafts 72 and 76 to be described later.

Figure 10:
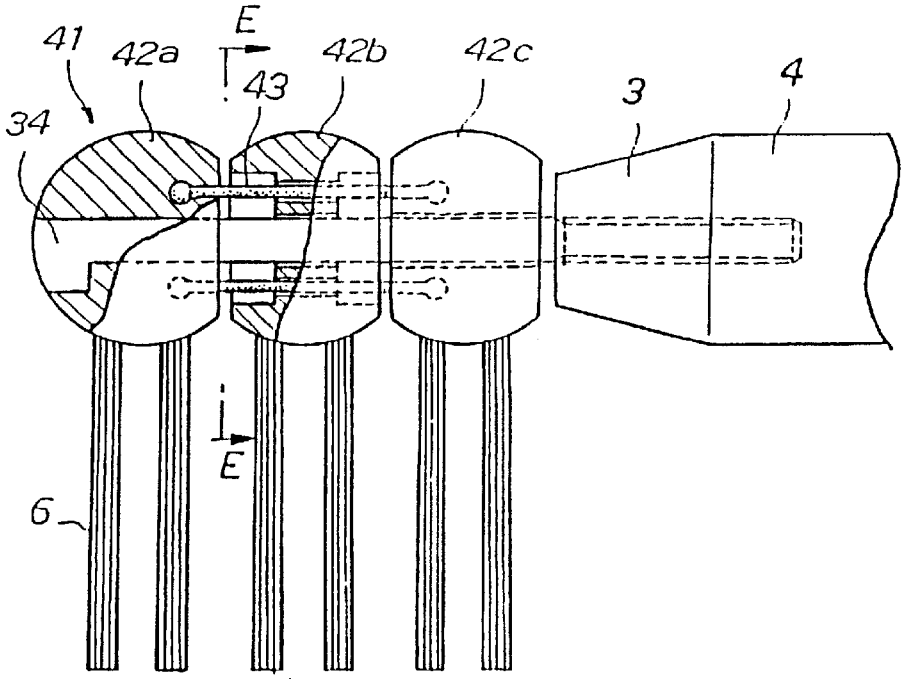
FIG. 10 is a partly sectional side view of an oscillatable brush head according to the present invention, which uses rubber ligaments.
Figure 11:
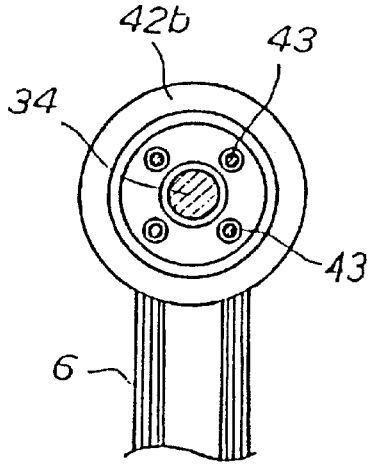
FIG. 11 is a cross-sectional view taken along the line E—E in FIG. 10.

FIG. 10 is a partly sectional side view of an oscillatable brush head according to the present invention, which uses rubber ligaments; and FIG. 11 is a cross-sectional view taken along the line E—E in FIG. 10.

In the brush head 41, a plurality of brush segments 42*a,* 42*b* and 42*c* are connected to one another with rubber ligaments serving as restoring means 43, and a center shaft 34 is fixed to the outermost brush segment 42*a.* The other brush segments 42*b* and 42*c* are pivotally fitted onto the center shaft 34; and the center shaft 34 is screwed into the neck 3.

In the brush head 41 having the above constitution, the intermediate brush segments 42*b* and 42*c* can be designed to be oscillated by the restoring means 43 in the same manner as described above. In this case, similar effects can be obtained, even if the brush segments 42*a,* 42*b* and 42*c* are connected by rubber ligaments serving as the restoring means 43 between every adjacent two segments.

Figure 12:
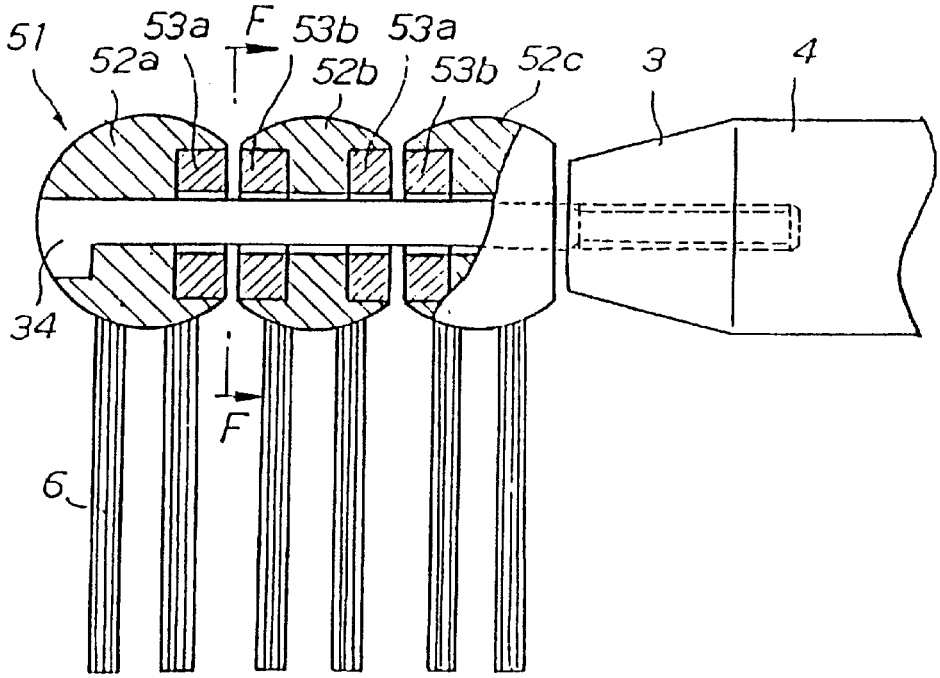
FIG. 12 is a partly sectional side view of an oscillatable brush head according to the present invention, which uses magnets.
Figure 13:
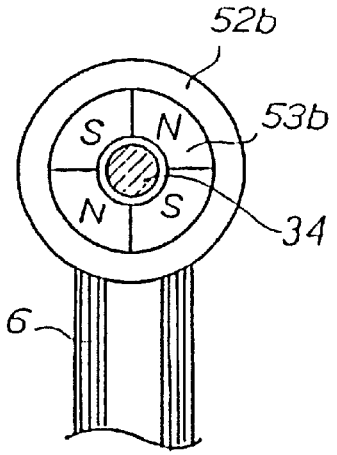
FIG. 13 is a cross-sectional view taken along the line F—F in FIG. 12.

FIG. 12 is a partly sectional side view of an oscillatable brush head according to the present invention, which uses magnets; and FIG. 13 is a cross-sectional view taken along the line F—F in FIG. 12.

The brush head 51 is of a constitution in which a center shaft 34 is fixed to the outermost brush segment 52*a,* with the other brush segments 52*b* and 52*c* being fitted on the center shaft 34 to be supported pivotally thereby, and the resulting shaft 34 is screwed into a neck 3. The brush segments 52*a,* 52*b* and 52*c* are provided on opposing faces with magnets 53*a* and 53*b.* Each magnet 53*a*(53*b*) is divided into sectors, and they are magnetized respectively. The magnets 53*a* and 53*b* are opposed to each other such that each magnetic sector in the former and that in the latter may have opposite polarities and attract each other.

In the brush head 51 having the above constitution, the intermediate brush segments 52*b* and 52*c* can likewise be designed to be oscillated by the magnets 53*a* and 53*b* serving as the restoring means, like in the foregoing embodiment.

Figure 14:
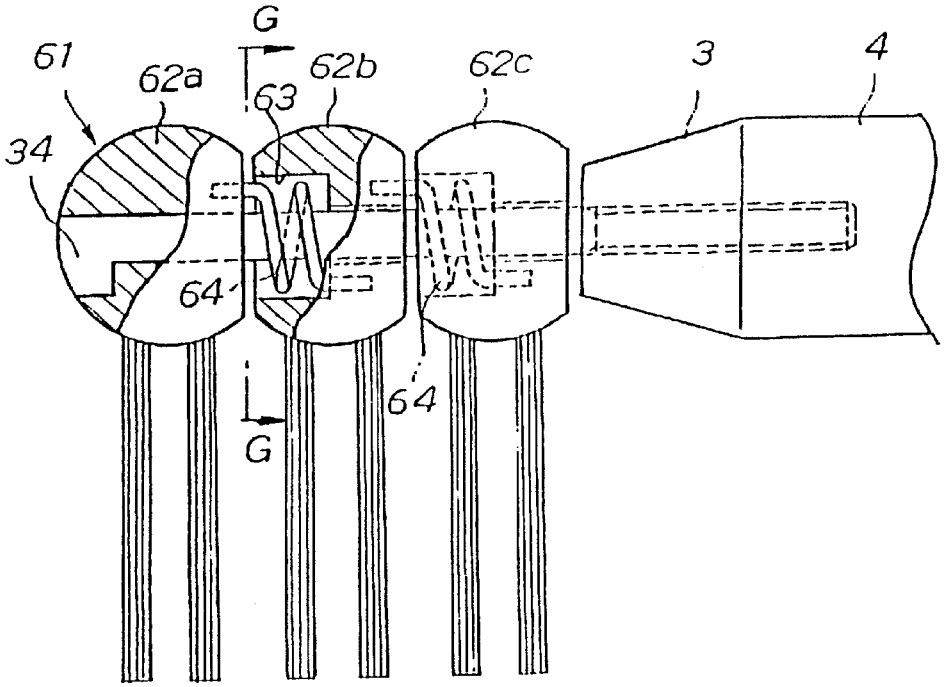
FIG. 14 is a partly sectional side view of an oscillatable brush head according to the present invention, which uses springs.
Figure 15:
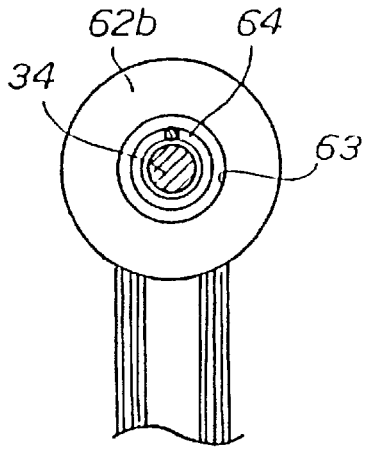
FIG. 15 is a cross-sectional view taken along the line G—G in FIG. 14.

FIG. 14 is a partly sectional side view of an oscillatable brush head according to the present invention, which uses springs; and FIG. 15 is a cross-sectional view taken along the line G—G in FIG. 14.

The brush head 61 is of a constitution in which a center shaft 34 is fixed to the outermost brush segment 62*a,* with the other brush segments 62*b* and 62*c* being fitted on the center shaft 34 to be supported pivotally thereby, and the resulting shaft 34 is screwed into the neck 3. The brush segments 62*a,* 62*b* and 62*c* are connected to one another by coil springs 64 serving as restoring means disposed in large-diameter bores 63 defined in the other brush segments 62*b* and 62*c,* respectively.

In the brush head 61 having the above constitution, the intermediate brush segments 62*b* and 62*c* can likewise be designed to be oscillated by the coil springs 64 serving as the restoring means.

Figure 16:
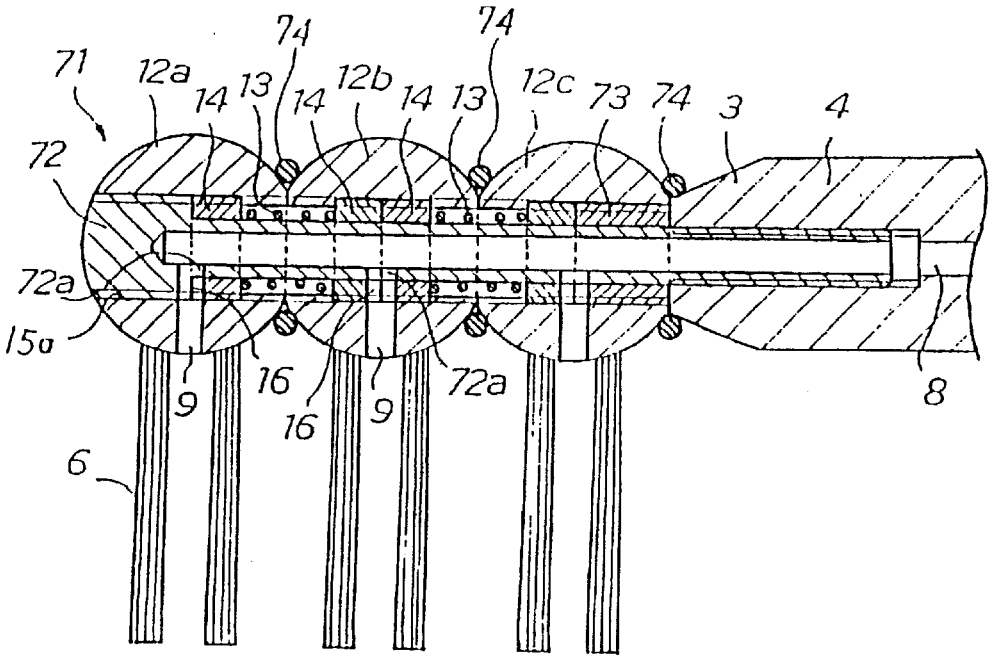
FIG. 16 is a vertical cross-sectional view of another oscillatable brush head according to the present invention, which uses springs.

FIG. 16 is a vertical cross-sectional view of another oscillatable brush head according to the present invention, which uses springs. The brush head 71 is of a constitution which uses the brush segments 12*a,* 12*b* and 12*c* and springs 13 for connecting them, as described above. The ring-shaped threaded pieces 14 present at both ends of the springs 13 are screwed into threaded holes 15*a* defined in the brush segments 12*a,* 12*b* and 12*c,* respectively, in the same manner as described before. A round pipe-like center shaft 72 is screwed into the outermost brush segment 12*a,* and the other brush segments 12*b* and 12*c* are fitted on the center shaft 72 to be supported pivotally thereby; while a ring-shaped threaded piece 73 is screwed into the innermost brush segment 12 such that the segment 12*c* is abutted against the neck 3, and the proximal portion of the center shaft 72 is fitted into the neck 3.

The center shaft 72 has a hollow structure for permitting passage of water, air, an antiseptic solution, etc. This hollow space communicates, through openings 72*a* opposing notches 16 defined in the threaded pieces 14, to communicating passages 9 of the brush segments 12*a,* 12*b* and 12*c,* respectively. In addition, O rings 74 for sealing are fitted at the interfaces among the brush segments 12*a,* 12*b* and 12*c*.

The brush head 71 of the above constitution is obtained by modifying the flexible brush head 11 into an oscillatable type, and the threaded pieces 14 are locked by screwing the center shaft 72 into the brush segment 12*a*. The springs 13 serving as the restoring means resiliently oscillate the intermediate brush segments 12*b* and 12*c* with respect to the center shaft 72.

Figure 17:
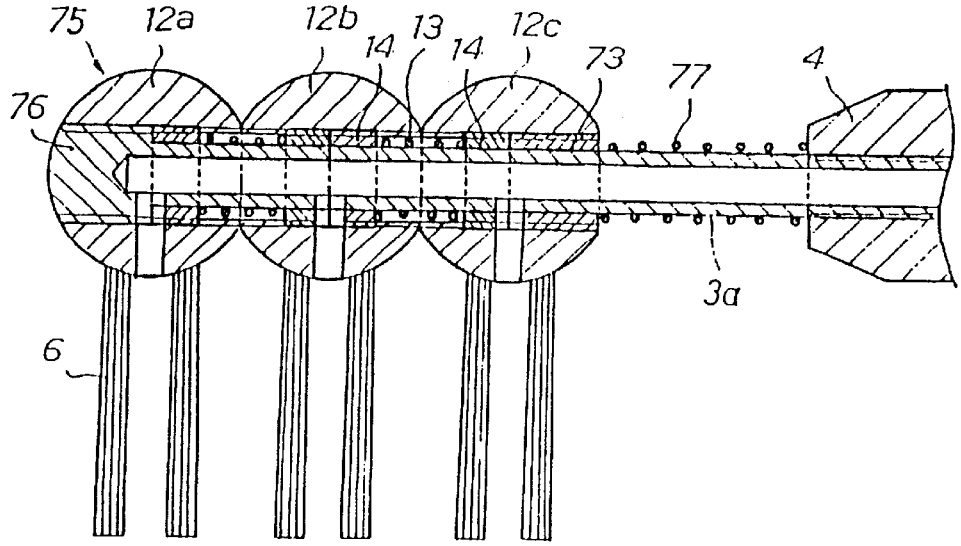
FIG. 17 is a vertical cross-sectional view of an oscillatable brush head according to the present invention, which uses a helical compression spring.

FIG. 17 is a vertical cross-sectional view of an oscillatable brush head according to the present invention, which uses a helical compression spring.

The brush head 75 has the same constitution as the brush head 71, except that the former has a long center shaft 76 serving also as the neck and that a helical compression spring 77 is interposed between the innermost brush segment 12*c* and the handle 4 to define a neck 3*a*.

Generally, when one puts a toothbrush deep into the mouth so as to brush the back teeth, the toothbrush tends to apply an excessive force to the retromolar pads and the platum, as well as, to hamular notches. In the brush head 75 of the above constitution, the helical compression spring 77 interposed between the brush head 75 and the handle 4 exerts, in such cases, an action of buffering the force applied from the hand to avoid application of an excessive force to the platum and the like.

Figure 18:
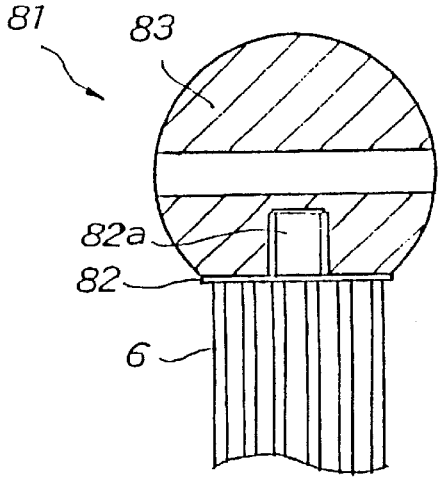
FIG. 18 is an enlarged cross-sectional view showing a brush replacing structure in the brush head according to the present invention.
Figure 19:
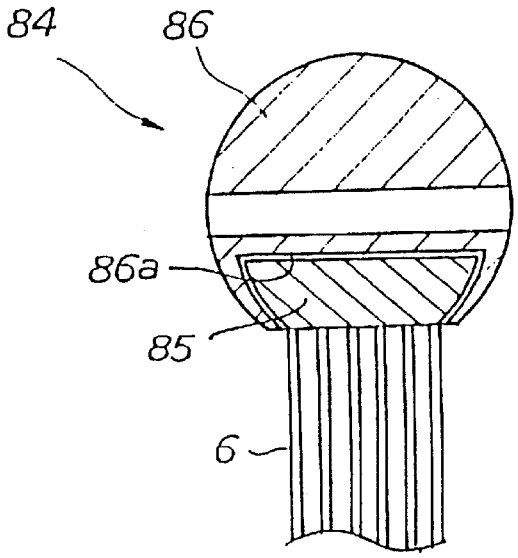
FIG. 19 is an enlarged cross-sectional view showing a brush replacing structure in the brush head according to the present invention.

FIGS. 18 and 19 each are an enlarged cross-sectional view showing a brush replacing structure in the brush head according to the present invention.

A brush segment 81 shown in FIG. 18 has a constitution, in which bristle bundles 6 are formed to extend vertically from a plate 82 having a screw 82*a,* and the screw 82*a* is screwed into a brush base 83. A brush segment 84 shown in FIG. 19 has a constitution, in which bristle bundles 6 are formed to extend vertically from a small base 85, and the small base 85 is fitted into a recess 86*a* defined in the body of a brush base 86.

Since the brush segments 81 and 84 having the constitutions as described above are designed to be screwed or fitted into the brush bases, respectively, they can be replaced if the bristle bundles 6 are worn out or contaminated.

Figure 20:
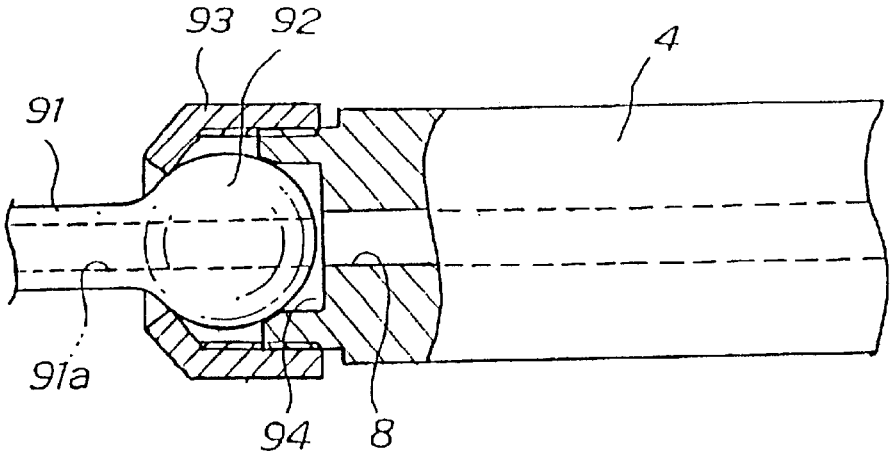
FIG. 20 is a partly sectional enlarged side view of the neck in the brush head according to the present invention.

FIG. 20 is a partly sectional enlarged side view of the neck in a brush head according to the present invention.

The neck 91 has a ball joint 92 at the proximal end and a lock nut 93 is fitted to the distal end of the handle 4. The lock nut 93 is for fixing the angle of the neck 91. The neck 91 contains a channel 91*a* penetrating the ball joint 92. A dent 94 is formed on the distal end of the handle 4, to which the end opening of the ball joint 92 opposes. The dent 94 communicates to the passage 8 of the handle 4.

In the neck 91 having the above constitution, since the ball joint 92 enables adjustment of the angle of the neck 91, this constitution can be applied well to brushing of portions of teeth difficult to treat including back faces of the front teeth.

Figure 21:
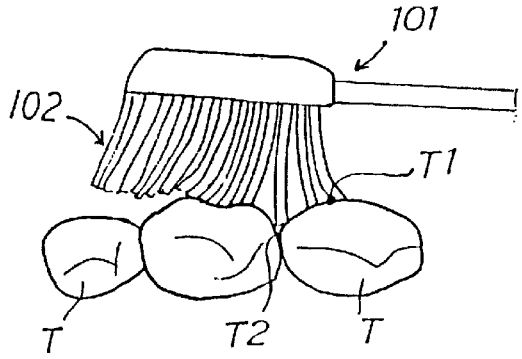
FIG. 21 is an explanatory drawing of a toothbrush of the prior art shown for comparison of actions.
Figure 22:
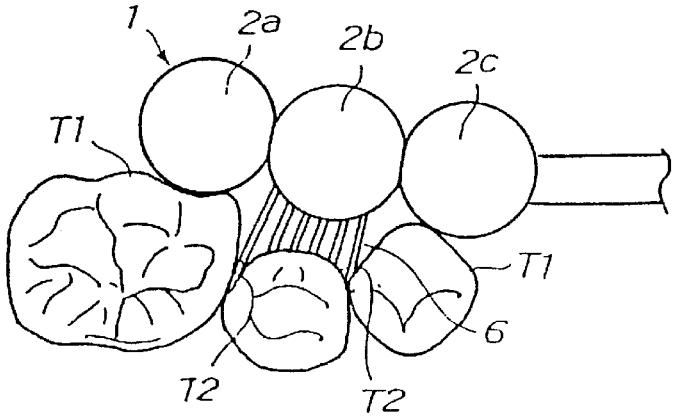
FIG. 22 is an explanatory drawing of a toothbrush according to the present invention shown for comparison of actions.
Figure 23:
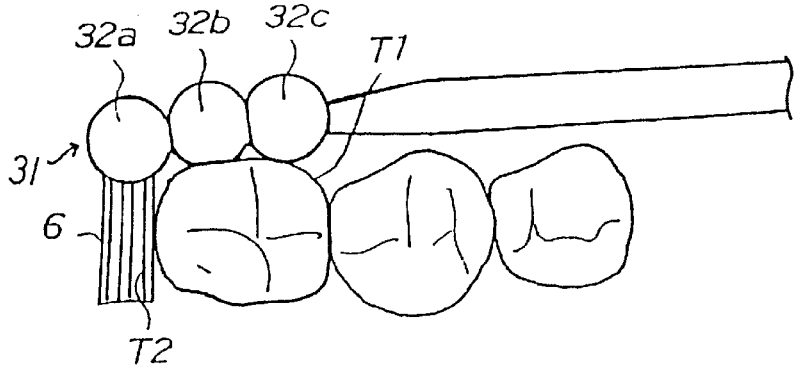
FIG. 23 is an explanatory drawing of a toothbrush according to the present invention shown for comparison of actions.

FIGS. 21 to 23 are explanatory drawings shown for comparing actions of toothbrushes of the present invention with those of the conventional toothbrush.

When the toothbrush having the brush head according to the embodiment of the present invention is used, a user grips the handle 4 and applies the bristle bundles 6 against the teeth to brush them like one uses a conventional toothbrush. Here, since the teeth have irregular side faces, there occurs a portion T1 to which the bristle ends are applied strongly and a portion T2 to which the bristle ends are applied softly, as shown in FIG. 21.

However, in the toothbrushes having the brush head 1 (11, 21 . . . ) according to the embodiment of the present invention, when the bristle bundles 6 of the brush segments 2*a,* 2*b* and 2*c* are subjected to strong pressures, the brush segments are caused to retract and twist by the reactive forces from the surface of the tooth, respectively, even in the presence of bad dentition or malocclusion, as shown in FIG. 22. When the brush segments are brought to positions where they are subjected to low pressures, the segments resiliently return by themselves to their original positions, respectively. As a result, the ends of bristles can be applied evenly all over the tooth surfaces, so that the teeth can be cleaned uniformly and that injury of the teeth by the brush can be avoided.

In the case of the conventional brush head 101, it occurs that, as shown in FIG. 21, the portion T1 to which the bristle ends are applied strongly prevents the brush head from giving a sufficient pressure to scrape off debris present at the portion T2 to which the bristle ends are applied softly or that the bristle ends do not reach such portions T2 to leave them unbrushed. On the other hand, the brush head according to the present invention can give a uniform tooth brushing effect, since brush segments are designed to be shiftable independently to distribute the contact pressure between the brush heads and the teeth depending on the level of the pressure.

In addition, in the osocillatable brush head 31, although a distal face T2 of a back tooth which tends to remain unbrushed since the side face T1 of that tooth forms an obstacle to the brush head, as shown in FIG. 23, the brush segments 32*b* and 32*c* oscillatory shift independently to enable smooth brushing of such face with the outermost brush segment 32*a*.

As described above, in the brush head according to the present invention, the brush segments undergo resilient motions independently even if there are obstructive protrusions and can brush the teeth to every recess without failure.

The brush of the present invention exhibits the following effects.

Since the brush head is composed essentially of retractable brush segments, the ends of bristles are applied evenly to the uneven tooth surfaces which vary depending on the teeth alignment of a user. Thus, the toothbrush having the simple structure can adjust itself easily to users individually and can effectively prevent tooth and buccal diseases by simple brushing motions.

It should be apparent to those skilled in the art that the present invention may be embodied in many other specific forms without departing from the spirit or scope of the invention.

Therefore, the present examples and embodiments are to be considered as illustrative and not restrictive, and the invention is not to be limited to the details given herein, but may be modified within the scope of the appended claims.

What is claimed is:

1. A brush head of a toothbrush having a gripping handle and a brush section for brushing teeth attached to a distal end of the handle; the brush section containing a brush base having bristle bundles implanted therein;

wherein the brush section is divided into at least two brush segments that are arranged along an axis of the toothbrush; and the brush segments are connected to each other with restoring means which permits restorable torsional and bending deformations in all directions with respect to the toothbrush axis, and said brush head further comprising a mounting/dismounting mechanism interposed between the brush section and the handle.

2. The brush head of a toothbrush according to claim 1, wherein the brush base is made of a resilient material which permits restorable torsional and bending deformations in all directions with respect to the toothbrush axis.

3. The brush head of a toothbrush according to claim 2, wherein the brush base has a bristled portion formed separate from a main body of the brush base, and a screw engagement mechanism, a fitting mechanism or a mounting/dismounting mechanism of other constitutions for removably locking the bristled portion against the brush base is interposed between them.

4. The brush head of a toothbrush according to claim 2, further comprising a passage communicating from the handle to the brush base and opens between the bristle bundles.

5. The brush head of a toothbrush according to claim 2, further comprising a ball joint having a lock nut, which is interposed between the brush section and the handle.

6. The brush head of a toothbrush according to claim 1, further comprising a pivot shaft for pivotally supporting the brush segments with respect to the toothbrush axis, and the pivot shaft is attached to the handle.

7. The brush head of a toothbrush according to claim 1, wherein the brush base has a bristled portion formed separate from a main body of the brush base, and a screw engagement mechanism, a fitting mechanism or a mounting/dismounting mechanism of other constitutions for removably locking the bristled portion against the brush base is interposed between them.

8. The brush head of a toothbrush according to claim 1, further comprising a passage communicating from the handle to the brush base and opens between the bristle bundles.

9. The brush head of a toothbrush according to claim 1, further comprising a ball joint having a lock nut, which is interposed between the brush section and the handle.

10. The brush head of a toothbrush according to claim 1, wherein the restoring means is a resilient resin material.

11. The brush head of a toothbrush according to claim 1, wherein the restoring means is a rubber material.

12. The brush head of a toothbrush according to claim 1, wherein the restoring means is a spring.

13. The brush head of a toothbrush according to claim 1, wherein the restoring means is a rubber ligament.

14. The brush head of a toothbrush according to claim 1, wherein the restoring means is a magnet.

15. The brush head of a toothbrush according to claim 1, wherein a center shaft is fixed to an outermost brush segment, and any brush segments other than said outermost brush segment are fitted onto said shaft and are rotatably supported by said shaft, and the mounting/dismounting mechanism comprises a threaded portion of said center shaft, which allows said center shaft to be removably screwed into a threaded hole of said handle.

16. A brush head of a toothbrush having a gripping handle and a brush section for brushing teeth attached to a distal end of the handle; the brush section containing a brush base having bristle bundles implanted therein;

wherein the brush section is divided into at least two brush segments that are arranged along an axis of the toothbrush; and the brush segments are connected to each other with restoring means which permits restorable torsional and bending deformations in all directions with respect to the toothbrush axis, and said restoring means is provided at each end with a mounting/dismounting mechanism to be removably fixed to the brush base.

17. The brush head of a toothbrush according to claim 16, wherein the mounting/dismounting mechanism comprises a threaded portion which is removably screwed into a threaded hole defined in the brush base along the toothbrush axis.

18. The brush head of a toothbrush according to claim 16, wherein the mounting/dismounting mechanism comprises a fitting piece which is retractably fitted into a bore defined in the brush base in the axial direction of the toothbrush and which has a rectangular cross section or other shapes permitting advancing and retracting movements only; and an engaging mechanism is located between the fitting piece and the brush base, the engaging mechanism being a resilient claw which removably engages the fitting piece with the brush base.

19. A brush head of a toothbrush having a gripping handle and a brush section for brushing teeth attached to a distal end of the handle; the brush section containing a brush base having bristle bundles implanted therein;

wherein the brush section is divided into at least two brush segments that are arranged along an axis of the toothbrush; and the brush segments are connected to each other with restoring means which permits restorable torsional and bending deformations in all directions with respect to the toothbrush axis, wherein said brush base is made of a resilient material which permits restorable torsional and bending deformations in all directions with respect to the toothbrush axis, and said brush head further comprising a pivot shaft for pivotally supporting the brush segments with respect to the toothbrush axis, and the pivot shaft is attached to the handle.

* * * * *